US008651855B2

(12) United States Patent
Cagle et al.

(10) Patent No.: US 8,651,855 B2
(45) Date of Patent: Feb. 18, 2014

(54) CANDLE WITH WAX BEADS AND SOLID WAX TOPPING

(75) Inventors: John E. Cagle, Greenfield, MA (US); Hope M. Klein, Galena, OH (US); Lauren O'Hara, Suffield, CT (US)

(73) Assignee: The Yankee Candle Company, Inc., South Deerfield, MA (US)

( * ) Notice: Subject to any disclaimer, the term of this patent is extended or adjusted under 35 U.S.C. 154(b) by 442 days.

(21) Appl. No.: 12/796,239

(22) Filed: Jun. 8, 2010

(65) Prior Publication Data

US 2011/0300496 A1 Dec. 8, 2011

(51) Int. Cl.
*C11C 5/02* (2006.01)

(52) U.S. Cl.
USPC ..... 431/289; 431/291; 431/288; 431/298; 44/275; 53/431

(58) Field of Classification Search
USPC ..... 431/289, 35, 293, 325, 291; 44/275; 362/171
See application file for complete search history.

(56) References Cited

U.S. PATENT DOCUMENTS

| | | | | |
|---|---|---|---|---|
| 4,826,428 | A * | 5/1989 | Lam | 431/291 |
| 6,648,631 | B2 * | 11/2003 | Wright et al. | 431/291 |
| 7,086,752 | B1 * | 8/2006 | Feuer | 362/161 |
| 2006/0057530 | A1 * | 3/2006 | Kubicek et al. | 431/325 |
| 2007/0020571 | A1 | 1/2007 | Burkhamer et al. | |
| 2007/0048684 | A1 * | 3/2007 | Cole et al. | 431/291 |
| 2007/0144058 | A1 | 6/2007 | Chen et al. | |
| 2007/0169404 | A1 | 7/2007 | Cagle | |
| 2007/0169405 | A1 * | 7/2007 | Cagle | 44/275 |
| 2010/0132250 | A1 * | 6/2010 | Uptain et al. | 44/275 |

OTHER PUBLICATIONS

International Search Report issued for PCT/US2011/039435, dated Oct. 14, 2011 (2 pages).

* cited by examiner

*Primary Examiner* — Steven B McAllister
*Assistant Examiner* — Nikhil Mashruwala
(74) *Attorney, Agent, or Firm* — Wilmer Cutler Pickering Hale and Dorr LLP

(57) ABSTRACT

A candle includes a vessel of some volume containing some smaller volume of at least one variety of wax beads, having a diameter of less than or equal to 2.35 millimeters and in most embodiments also including a particular fragrance and color pigment. The was beads topped with a solid wax topping. The solid wax topping may cover the entire exposed surface of the candle, holding the wax beads in place during shipping and use and holding the wick in a centralized location.

6 Claims, 2 Drawing Sheets

CANDLE WITH WAX BEADS AND SOLID WAX TOPPING

BACKGROUND OF THE INVENTION

The present invention relates to scented wax candles and more particularly to a scented candle made of scented wax beads and covered with a solid wax topping.

Scented candles are a popular fixture in many homes. Generally, candles consist of one or more solid wax components, with one or more fragrances. Of some increasing popularity are candles made of small beads of scented wax, to be assembled in a vessel by the end user, marketed as do-it-yourself kits.

While candles made from beads of wax have many benefits, they can also present some practical difficulties. First, most of the currently marketed wax bead candles are only available as do-it-yourself kits, where the beads are shipped and available for purchase separately from the container and the wick. The consumer has the benefit of being able to choose the container apart from the wax portion, but the consumer must also assemble the candle. Filling a container with thousands of small beads while keeping the wick in place could be a messy task. In addition, current candles made of wax beads are manufactured one at a time which makes it difficult to mass market such candles.

Of course, the wholesaler or retailer may assemble the candles pre-purchase. In a wax bead candle, however, the wick, which is normally held in a central position in solid wax candles, may shift during transportation and in use because the beads are fluid. The wax beads themselves also may shift during transportation and use, resulting in loss or an uneven appearance. The latter result is especially problematic if different wax bead colors and/or fragrances are layered to provide an aesthetic effect.

It is a principal object of the present invention to provide a candle comprised of wax beads that can be manufactured, packaged and shipped in commercial quantities without significant added cost or processing steps to keep the beads in place.

Another object of the present invention it to provide a candle comprised of wax beads that maintains the position of the wick in the center of the candle vessel.

Another object of the present invention provide a candle comprised of wax beads that can be manufactured using high volume manufacturing methods.

SUMMARY OF THE INVENTION

The present invention is a scented candle comprised of a vessel of some volume containing some smaller volume of at least one variety of wax beads, preferably having a diameter of less than 2.35 millimeters and some particular fragrance and color, and topped with a solid layer of wax. In one embodiment, the solid layer of wax covers the entire exposed surface of the candle, holding the wax beads in place during shipping and use and holding the wick in a centralized location. The bead geometry will range from spherical to oblong with a small percentage of the beads being substantially flat. The typical diameter range will be 0.35 mm-2.35 mm.

BRIEF DESCRIPTIONS OF THE DRAWINGS

DETAILED DESCRIPTION OF PREFERRED EMBODIMENTS

Figure 1:
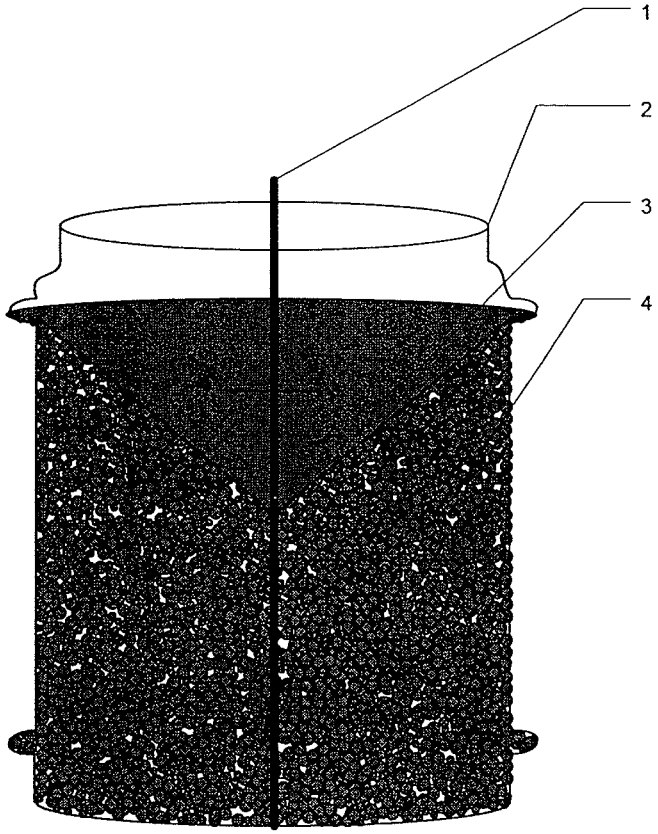
FIG. 1 is an elevational view of a candle of the present invention, showing the candle vessel containing the wick and the scented wax beads, covered by a solid wax layer.

With reference to FIG. 1, a candle is shown having a vessel 2 containing a volume of wax beads 4 covered with a solid wax topping 3. The wax beads 4 and solid wax topping 3 encircle the wick 1. The vessel 2 must be of sufficient volume to contain the wax beads 4 and the solid wax topping 3 in their entirety. In a preferred embodiment the vessel 2 is mad of a transparent heat resistant material such a clear glass. The wick 1 runs vertically through the volume of wax beads 4 and the solid wax topping 3 and is left exposed at the top of the candle for lighting.

The bead geometry will range from spherical to oblong with a small percentage of the beads being substantially flat. The typical diameter range will be 0.35 mm-2.35 mm. Each variety of wax beads 4 would be of a single pigment. The wax beads 4 may be coated or infused with a fragrance, unscented, or include an odor abatement substance. The wax material comprising wax beads 4 has a melting point between 126° F. and 145° F.

In one embodiment, the volume of wax beads 4 may be limited to one pigment and one fragrance. In other embodiments, the volume may also consist in wax beads 4 of more than one fragrance and/or more than one pigment. The varieties of wax beads 4 may be mixed in a variety of ways, including uniform mixtures, swirled mixtures, horizontal layers, and vertical layers.

In all embodiments, the final volume of wax beads 4 is covered and contained within the vessel 2 by the solid wax topping 3. The wax material comprising the solid wax topping 3 can be of the same melting point as the wax material comprising wax beads 4, and in fact may be the same material as wax beads 4, with the same fragrance and pigment. The solid wax topping 3 is deposited as a liquid layer, and then allowed to cool and solidify. The solid wax topping cone-shaped geometry (or cone depth) may extend into the wax beads by up to ¾ the distance of the filled candle. However, the cone depth may be significantly less than this as well.

Figure 2:
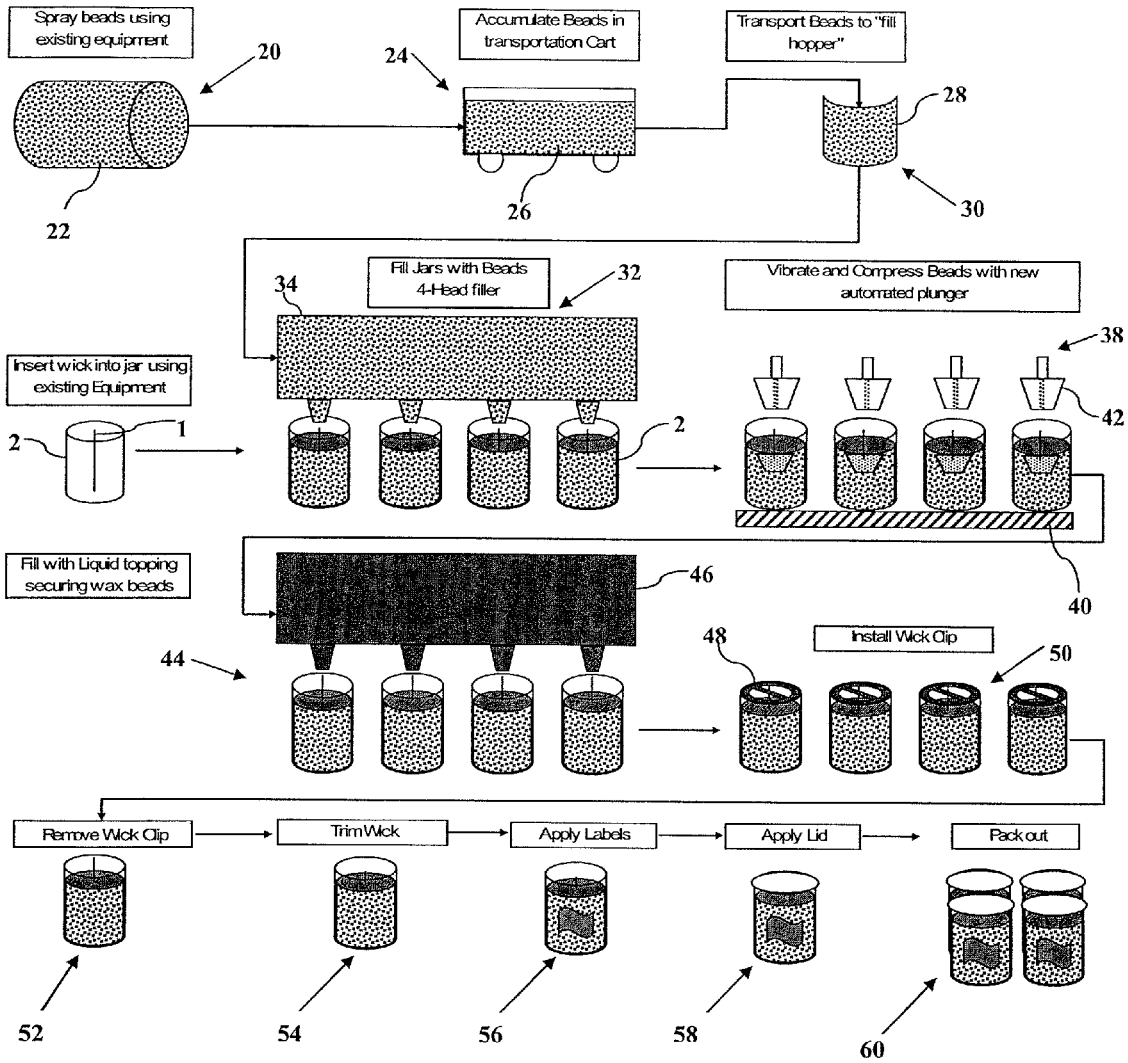
FIG. 2 is a schematic of the manufacturing process for making a candle of the present invention.

Referring to FIG. 2, in a preferred embodiment, in step 20, the candle is formed by using existing equipment to spray wax onto a drum 22 to form wax beads 4 of each variety of wax beads used in the candle. Then, in step 24 wax beads 4 are accumulated in a cart 26 for transportation. The wax beads 4 are transported to a filling hopper 28 in step 30, and the filling hopper 28 distributes wax beads 4 in step 32 to a filling station 34 which deposits a volume of wax beads 4 into a jar 2 prepared with wick 1. Jars are then transported in step 38 to a vibrating device 40, which settles the wax beads 4. An automated plunging device 42, compresses the wax beads 4. Jars are then transported in step 44 to liquid wax depositing station 46 where solid wax topping 3 has been heated to its melting point and deposited into the jar to coat the exposed top surface of the volume of wax beads 4. Following the deposition of the liquid wax material comprising the solid wax topping 3, a wick clip 48 is installed in step 50 to hold the wick 1 in place during cooling. Once the solid wax topping 3 has cooled and solidified, the wick clip 48 is removed in step 52, the wick 1 is trimmed in step 54, and the jars are prepared for shipping and sale in steps 56, 58, 60.

The small beads of wax used in the present invention can produce stronger fragrances and can fill a room with fragrance more quickly because each bead melts faster than the typical solid wax candle. Because the overall surface area of the candle is increased, and each bead is coated or infused with fragrance, the wax bead candle can emit a stronger fragrance over its lifetime. In addition, each bead can be infused with concentrated fragrance, producing even stronger scents. These wax bead candles permit a wider variety of fragrance and pigment mixtures than existing solid candle varieties that must layer or swirl separately scented and/or colored layers together.

The present invention addresses the issues found in prior art candles made of wax beads. First, rather than requiring the consumer to assemble a candle themselves, a candle of the present invention would come pre-assembled in a vessel. The candle may be obtained in a variety of fragrances, pigments, or mixtures. Because the candle is comprised of these small beads, mixtures would be available in designs and varieties not otherwise possible with solid wax candles.

Using the process shown in FIG. 2 wax bead candles are easier to manufacture than the standard solid wax candle. Many existing manufacturing systems use beads of wax already, but then such manufacturing systems melt them to form the solid wax candle product. By making the candles out of wax beads, there are fewer manufacturing steps, requiring less time and energy.

While the foregoing invention has been described with reference to its preferred embodiments, various alterations and modifications will occur to those skilled in the art. All such alterations and modifications are intended to fall within the scope of the appended claims.

What is claimed is:

1. A candle comprising:

a container;

a volume of loose wax beads inserted in an opening of a container, said volume of wax beads said sunken portion extending essentially across the opening of the container, including a sunken portion in a top surface of said volume of wax beads, said volume of wax beads having a height around a perimeter of said volume greater than the height of said volume of wax beads in a middle of said volume of wax beads, wherein the heights of the perimeter and middle of said volume being measured from the bottom surface of said candle;

a solid wax layer deposited over the top of said volume of wax beads to form a solid wax layer over said wax beads so that said solid wax layer provides a continuous barrier between said wax beads and the opening in said container, said solid wax layer filling said sunken portion in said top surface of said volume of wax beads with said wax beads remaining in the form of beads beneath said wax layer;

a wick of sufficient length to protrude from the bottom of said candle through the top surface of said solid wax layer;

said wax beads comprising a color pigment and a fragrance and said solid wax layer comprising a color pigment and a fragrance;

said sunken portion having a conical or frustoconical shaped indentation in said top surface of said volume of wax beads;

wherein the solid wax layer holds the loose beads in place and holds the wick in a centralized location.

2. The candle of claim 1, wherein said wax beads have a diameter of less than or equal to 2.35 millimeters.

3. The candle of claim 1, wherein said wax beads are of a variety of geometries.

4. The candle of claim 1, wherein said wax beads have a diameter of between 0.35 mm and 2.35 mm.

5. The candle of claim 1, wherein said color pigment and fragrance of said wax beads are the same color pigment and fragrance of said solid wax layer are the same as the color pigment and fragrance.

6. The candle of claim 1, wherein a portion of said wax beads comprise more than one color pigment or more than one fragrance or both.

* * * * *

UNITED STATES PATENT AND TRADEMARK OFFICE

CERTIFICATE OF CORRECTION

PATENT NO. : 8,651,855 B2
APPLICATION NO. : 12/796239
DATED : February 18, 2014
INVENTOR(S) : John E. Cagle et al.

It is certified that error appears in the above-identified patent and that said Letters Patent is hereby corrected as shown below:

On the Title Page, item [57], in the Abstract:

Line 5, delete "was beads" and replace it with "wax beads".

In the Specification:

Column 2, under the Detailed Description Of Preferred Embodiments, line 6, delete "is mad" and replace it with "is made".

In the Claims:

Column 3-4, lines 30-23, should read as follows:

1. A candle comprising:

a container;

a volume of loose wax beads inserted in an opening of a container, said volume of wax beads ~~said sunken portion extending essentially across the opening of the container,~~ including a sunken portion in a top surface of said volume of wax beads, said sunken portion extending essentially across the opening of the container, said volume of wax beads having a height around a perimeter of said volume greater than the height of said volume of wax beads in a middle of said volume of wax beads, wherein the heights of the perimeter and middle of said volume being measured from the bottom surface of said candle;

a solid wax layer deposited over the top of said volume of wax beads to form a solid wax layer over said wax beads so that said solid wax layer provides a continuous barrier between said wax beads Signed and Sealed this
Ninth Day of September, 2014

Michelle K. Lee

Michelle K. Lee
*Deputy Director of the United States Patent and Trademark Office* and the opening in said container, said solid wax layer filling said sunken portion in said top surface of said volume of wax beads with said wax beads remaining in the form of beads beneath said wax layer;

a wick of sufficient length to protrude from the bottom of said candle through the top surface of said solid wax layer;

said wax beads comprising a color pigment and a fragrance and said solid wax layer comprising a color pigment and a fragrance;

said sunken portion having a conical or frustoconical shaped indentation in said top surface of said volume of wax beads;

wherein the solid wax layer holds the loose beads in place and holds the wick in a centralized location.

Column 4, line 28, correct claim 5 to read as follows:

5. The candle of claim 1, wherein said color pigment and fragrance of said wax beads are the same <u>as the</u> color pigment and fragrance of said solid wax layer ~~are the same as the color pigment and fragrance~~.